US011048190B1

(12) United States Patent
Wu

(10) Patent No.: US 11,048,190 B1
(45) Date of Patent: Jun. 29, 2021

(54) LEAK-PROHIBITING DEVICE OF TONER CARTRIDGE

(71) Applicant: GENERAL PLASTIC INDUSTRIAL CO., LTD., Taichung (TW)

(72) Inventor: Yi-Chia Wu, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/827,053

(22) Filed: Mar. 23, 2020

(51) Int. Cl.
*G03G 15/08* (2006.01)

(52) U.S. Cl.
CPC ..... *G03G 15/0886* (2013.01); *G03G 15/0867* (2013.01); *G03G 15/0872* (2013.01); *G03G 15/0877* (2013.01); *G03G 2215/0692* (2013.01)

(58) Field of Classification Search
CPC ..... G03G 15/0886; G03G 15/0875; G03G 15/0865; G03G 15/0879; G03G 2215/0692; G03G 21/1647
See application file for complete search history.

(56) References Cited

U.S. PATENT DOCUMENTS 9,152,084 B2 * 10/2015 Shiba ..... G03G 15/0872
9,482,988 B2 * 11/2016 Hosokawa ..... G03G 15/0865
2013/0272750 A1 * 10/2013 Matsumoto ..... G03G 15/0879 399/262
2014/0241757 A1 * 8/2014 Kikuchi ..... G03G 15/0877 399/258
2016/0004184 A1 * 1/2016 Kikuchi ..... G03G 15/0865 399/258

* cited by examiner

*Primary Examiner* — Walter L Lindsay, Jr.
*Assistant Examiner* — Jessica L Eley
(74) *Attorney, Agent, or Firm* — Muncy, Geissler, Olds & Lowe, P.C.

(57) ABSTRACT

A leak-prohibiting device includes a fixation mount for being mounted to an toner outlet of a housing of a toner cartridge, a valve member mounted in the fixation mount and forced by a first resilient member to seal an opening of the fixation mount, and a push member mounted in the fixation mount and moveable between an extended position where the push member is abutted against the valve member and a retracted position where an engagement portion of the push member is engaged with a position-limiting portion of the fixation mount such that the push member, on which a biasing force of a second resilient member exerts toward the extended position, is prohibited from moving from the retracted position to the extended position. As such, the leak-prohibiting device can positively block the toner cartridge and the toner cartridge can be repeatedly installed with less manual force.

13 Claims, 8 Drawing Sheets

LEAK-PROHIBITING DEVICE OF TONER CARTRIDGE

BACKGROUND OF THE INVENTION

1. Field of the Invention

The present invention relates generally to an electronic image-forming apparatus and more particularly, to a leak-prohibiting device of a toner cartridge for being used in an electronic image-forming apparatus.

2. Description of the Related Art

A conventional electronic image-forming apparatus, such as photocopier or printer, is equipped with a toner cartridge for supplying toners. To prevent toners contained in a toner cartridge that has not been installed in the electronic image-forming apparatus from leak, a plug, which receives a great biasing force from a compression spring, is usually used to seal the toner outlet. To install the toner cartridge of such design into the electronic image-forming apparatus, the user must apply a greater force to overcome the biasing force of the spring. In certain cases, the user may need to dismantle and then re-install the toner cartridge for many times. This repetitive operation is manual force consuming for the user and thus inconvenient. If a spring having a small biasing force is chosen in order to save manual force of the user upon installation or reinstallation of the toner cartridge, the problem of toner leak may happen easily. Therefore, how to positively block the toner outlet of the toner cartridge to ensure that the toner cartridge won't leak before it is installed and to provide a toner cartridge which is manual force-saving for a user repeatedly installing the toner cartridge due to, in particular, the cause of replacement is an issue that the manufacturers in this industry field need to solve.

SUMMARY OF THE INVENTION

The present invention has been accomplished in view of the above-noted circumstances. It is an objective of the present invention to provide a leak-prohibiting device, which can positively avoid toners contained in a toner cartridge from leak before the toner cartridge is installed into the electronic image-forming apparatus and enables a user to dismantle and then re-install the toner cartridge in a manual force-saving manner.

To attain the above objective, the present invention provides a leak-prohibiting device of a toner cartridge, which comprises a fixation mount, a valve member, a first resilient member, a push member, and a second resilient member. The toner cartridge includes a housing for storage of toners and a toner outlet provided at the housing. The fixation mount is adapted for being disposed in the toner outlet of the housing and includes a position-limiting portion and an opening to be communicated with an inside and an outside of the housing. The valve member is moveably mounted in the fixation mount and located by an inner side of the opening. The first resilient member is mounted in the fixation mount and imparts a biasing force on the valve member toward the opening to enable the valve member to seal the opening. The push member is provided with an engagement portion and mounted in the fixation mount in a way that the push member is located by an inner side of the valve member and moveable between an extended position where the push member is abutted against the valve member and a retracted position. The second resilient member is mounted in the fixation mount and imparts a biasing force on the push member toward the extended position. When the push member is located at the retracted position, the engagement portion of the push member is engaged with the position-limiting portion of the fixation mount such that the push member, which receives the biasing force of the second resilient member, is prohibited from moving from the retracted position to the extended position. As a result, the leak-prohibiting device can positively seal the toner cartridge and enables a user to dismantle and then re-install the toner cartridge in a manual force-saving manner.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
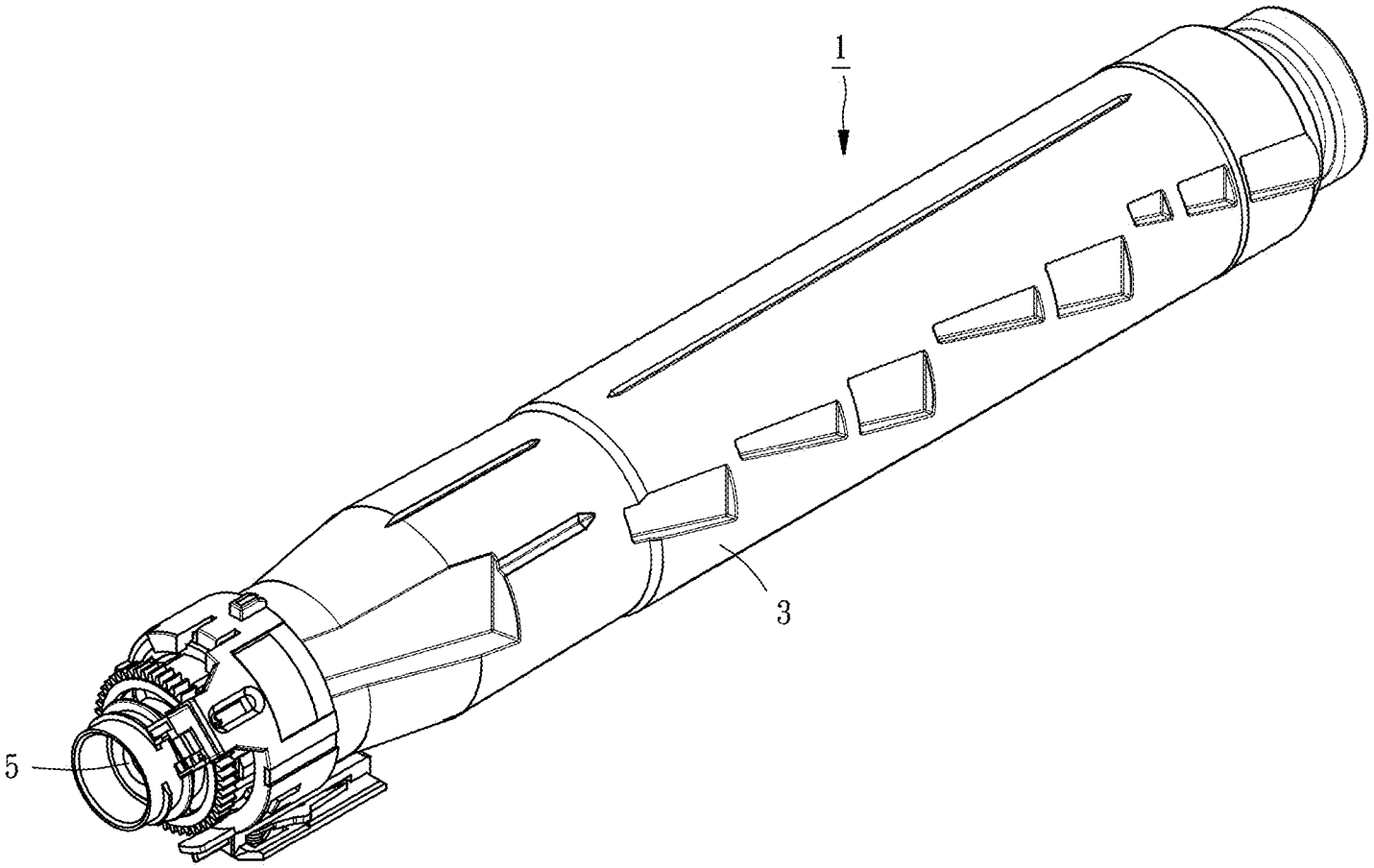
FIG. 1 is a perspective view of a toner cartridge according to an embodiment of the present invention.
Figure 2:
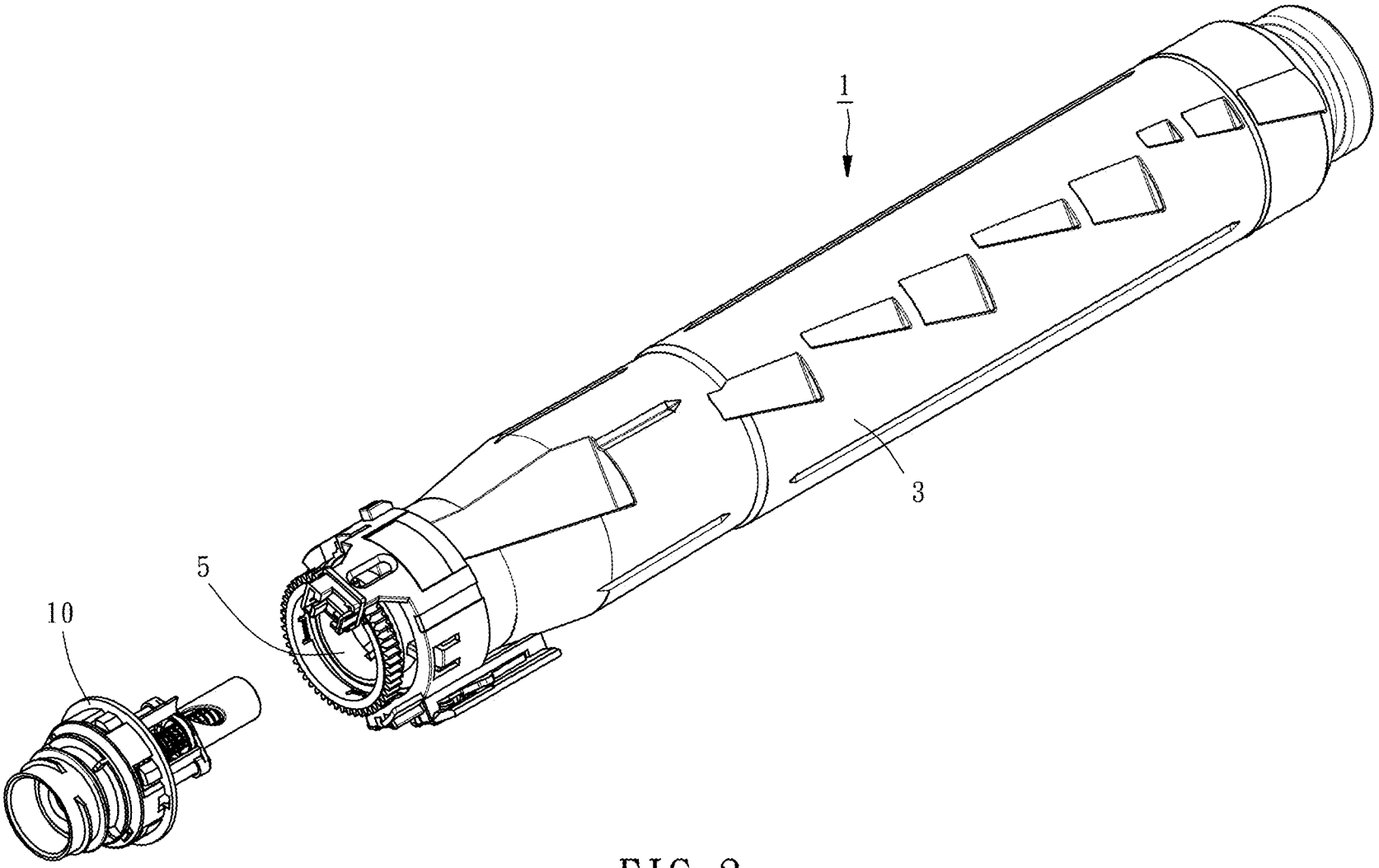
FIG. 2 is a partially exploded view of the toner cartridge of the embodiment of the present invention.
Figure 3:
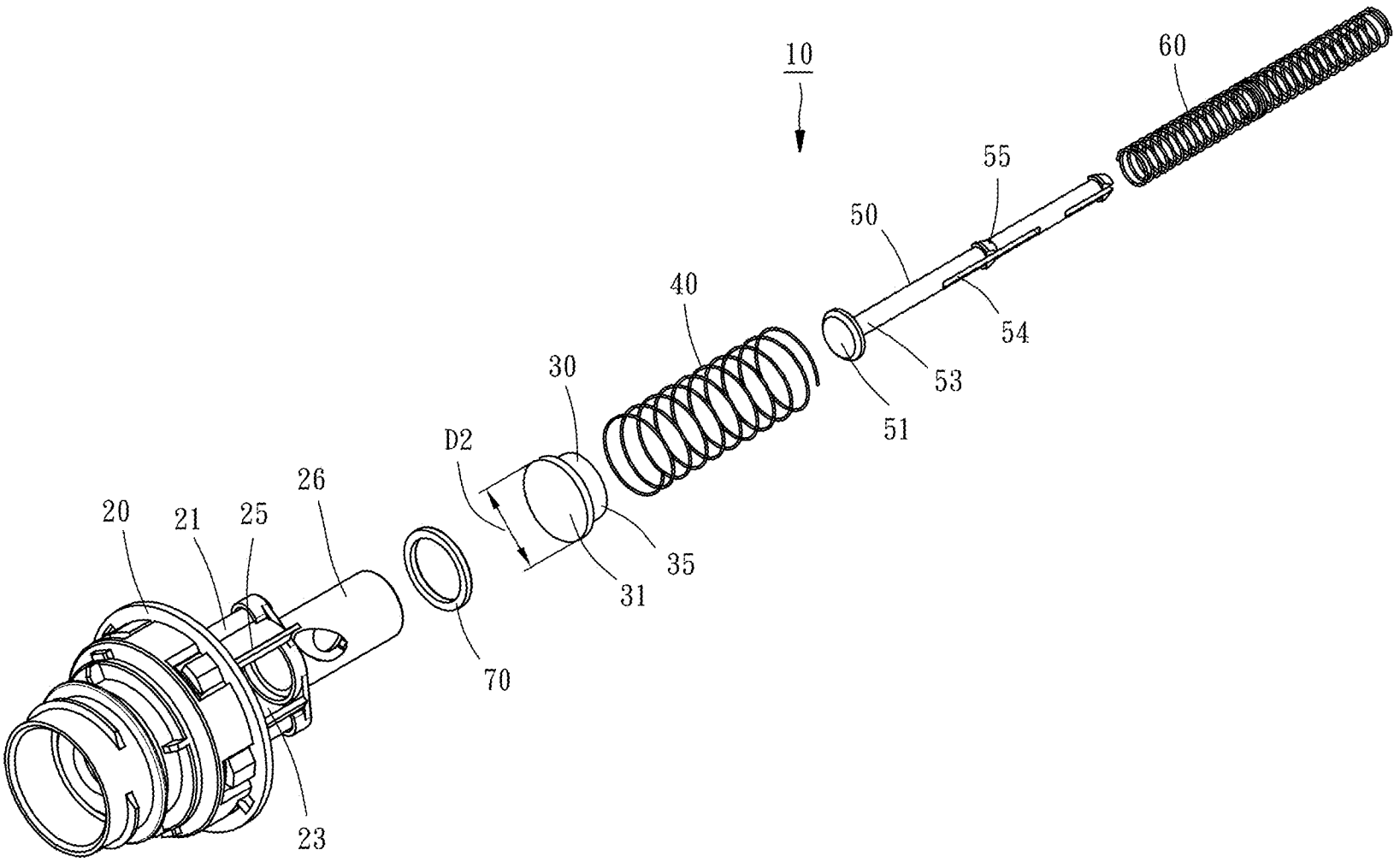
FIG. 3 is an exploded perspective view of a leak-prohibiting device of the toner cartridge of the embodiment of the present invention.
Figure 7:
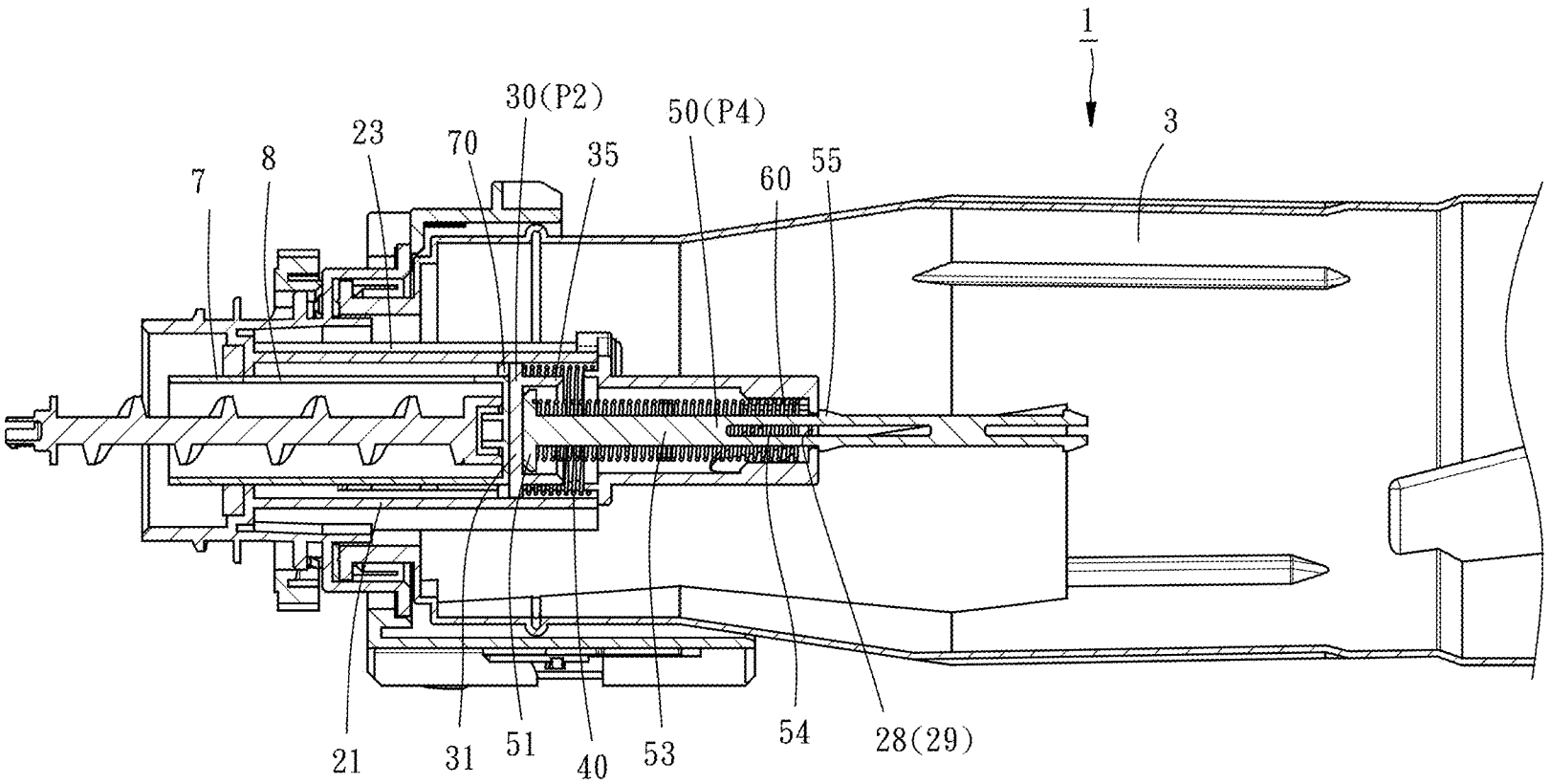
FIG. 7 is another section view of the toner cartridge of the embodiment of the present invention, showing that the valve member and the push member are forced to move inwardly, such that the opening of the fixation mount is not sealed by the valve member and the push member is located at a retracted position.

Hereunder one embodiment will be detailedly described with accompanying drawings for illustrating technical features and structure of the present invention. FIGS. 1 and 2 are perspective views showing a toner cartridge 1 that is equipped with a leak-prohibiting device 10 in accordance with a preferred embodiment of the present invention. The toner cartridge 1 is adapted to be installed in an electronic image-forming apparatus (not shown), such as photocopies, printer, etc. The electronic image-forming apparatus comprises a connecting member 7 with a toner inlet 8, as shown in FIG. 7. The toner cartridge 1 includes a housing 3 for storage of toners, a toner outlet 5 provided at an end of the housing 3, and the leak-prohibiting device 10. When the toner cartridge 1 is installed into the electronic image-forming apparatus, the connecting member 7 is extended into the leak-prohibiting device 10. Referring to FIGS. 2 and 3, the leak-prohibiting device 10 comprises a fixation mount 20, a valve member 30, a first resilient member 40, a push member 50, a second resilient member 60, and a seal member 70. It is to be first mentioned that the direction along the axis of the housing 3 of the toner cartridge 1 toward an inside of the housing 3 is defined in the present embodiment as an inside direction, i.e. an inner side, and the direction reverse to the inside direction is an outside direction, i.e. an outer side.

Figure 4B:
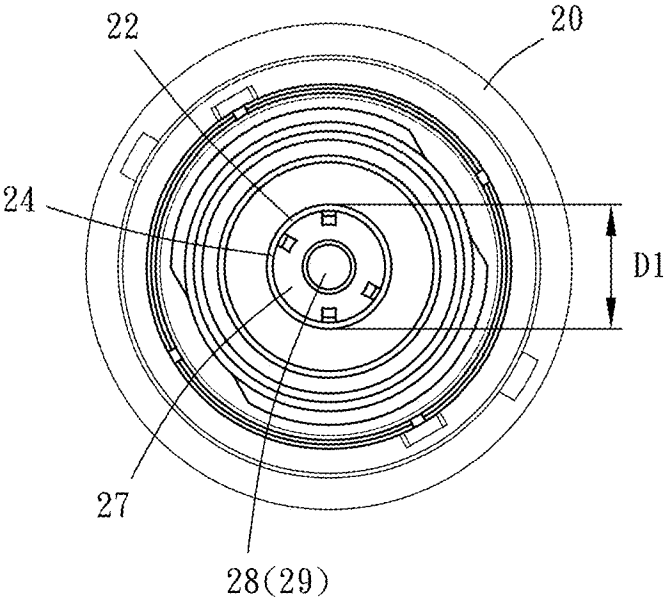
FIG. 4B is a lateral side view of the fixation mount of the leak-prohibiting device of the embodiment of the present invention.
Figure 4A:
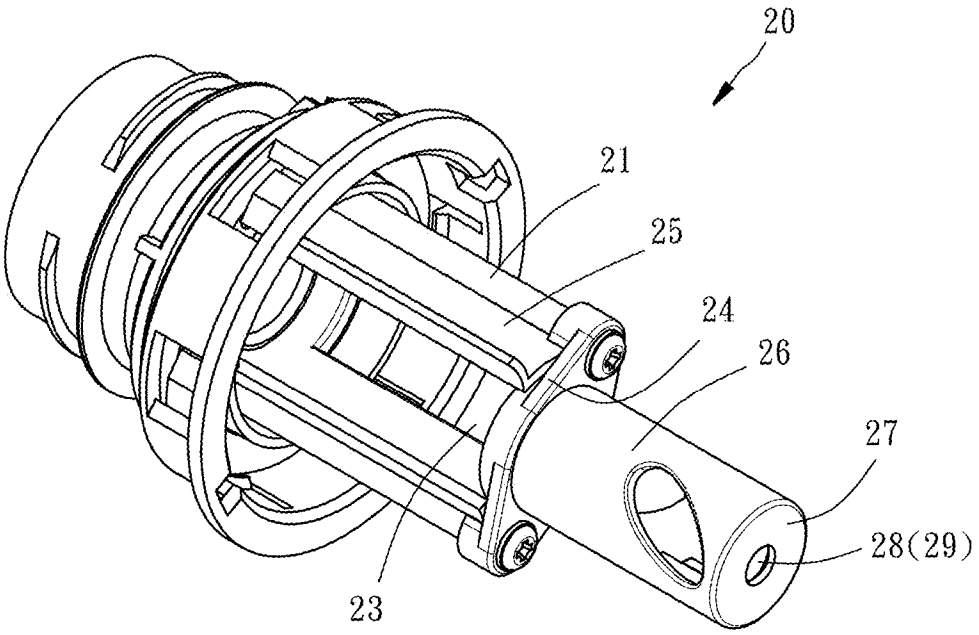
FIG. 4A is a perspective view of a fixation mount of the leak-prohibiting device of the embodiment of the present invention.

Referring to FIGS. 4A and 4B, the fixation mount 20 is disposed in the toner outlet 5 of the housing 3 and includes a tube portion 21 extending into an inside of the housing 3 of the toner cartridge 1, an opening 22 provided at an end, namely a first end, of the tube portion 21, two open grooves 23 provided at the periphery wall of the tube portion 21, a bottom wall 27 provided at the other end, namely a second end or inner end that is remote from the opening 22, of the tube portion 21, a position-limiting portion 28 provided at the bottom wall 27. The tube portion 21 includes a shoulder 24, a big-diameter section 25 adjacent to the opening 22, and a small-diameter section 26 adjacent to the position-limiting portion 28. The small-diameter section 26 extends from the big-diameter section 25 in a way that the shoulder 24 is formed at an interface between the small-diameter section 26 and the big-diameter section 25. The opening 22 is communicated with the inside of the housing 3, the outside of the housing 3, and the open grooves 23. As such, toners can reach at the opening 22 from the inside of the housing 3 through the open grooves 23. The position-limiting portion 28 includes or is realized as a through hole 29.

It is to be mentioned that the big-diameter section 25 and the small-diameter section 26 are two independent members in this embodiment. That is, the tube portion 21 is formed by two elements connected with each other. The shoulder portion 24 is located at an end of the big-diameter section 25, namely an inner end of the big-diameter section 25 that is adjacent to the small-diameter section 26. In another embodiment, the big-diameter section 25 and the small-diameter section 26 may be monolithically formed as one unity member.

Figure 6:
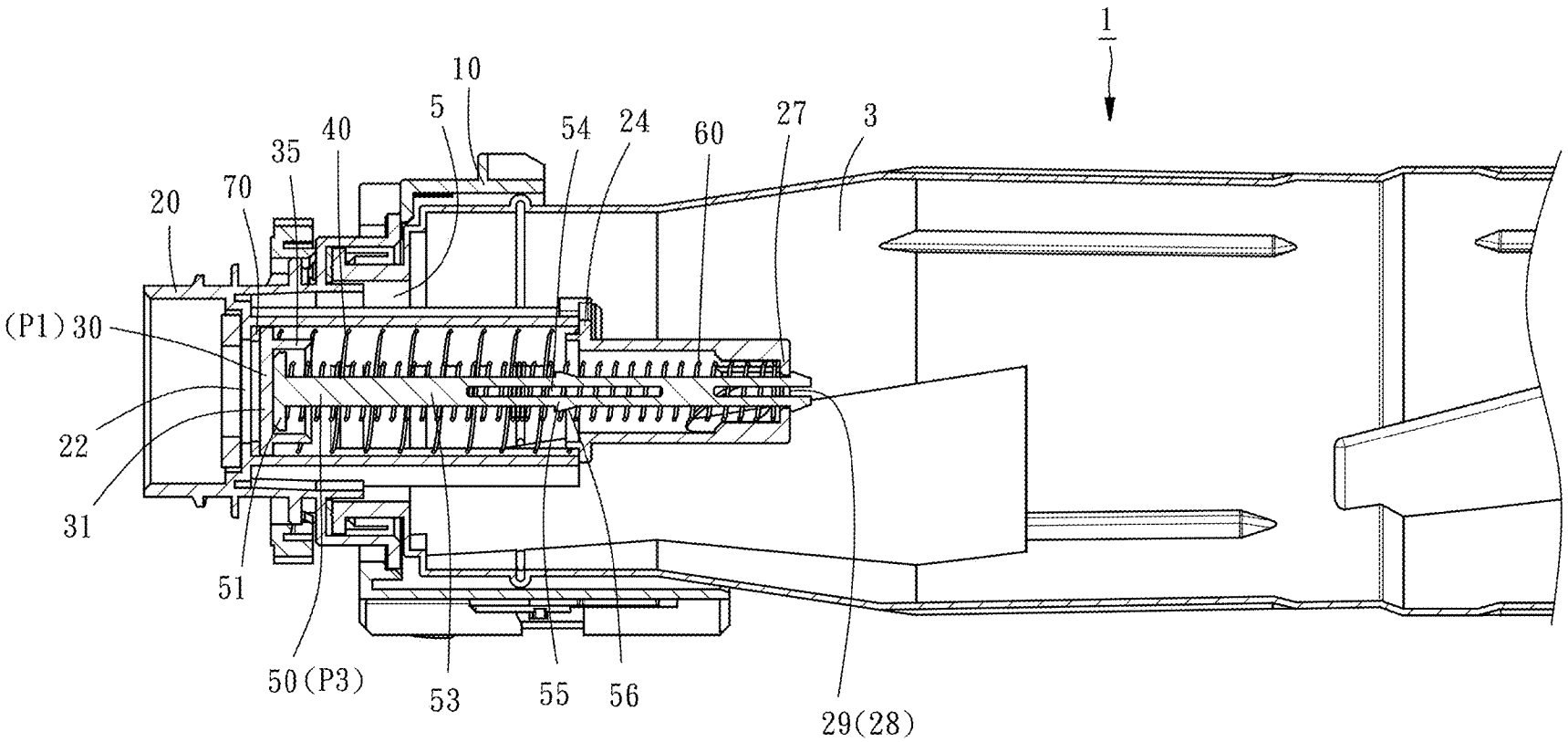
FIG. 6 is a sectional view of the toner cartridge of the embodiment of the present invention, showing that a valve member seals an opening of the fixation mount and the push member is located at an extended position.
Figure 8:
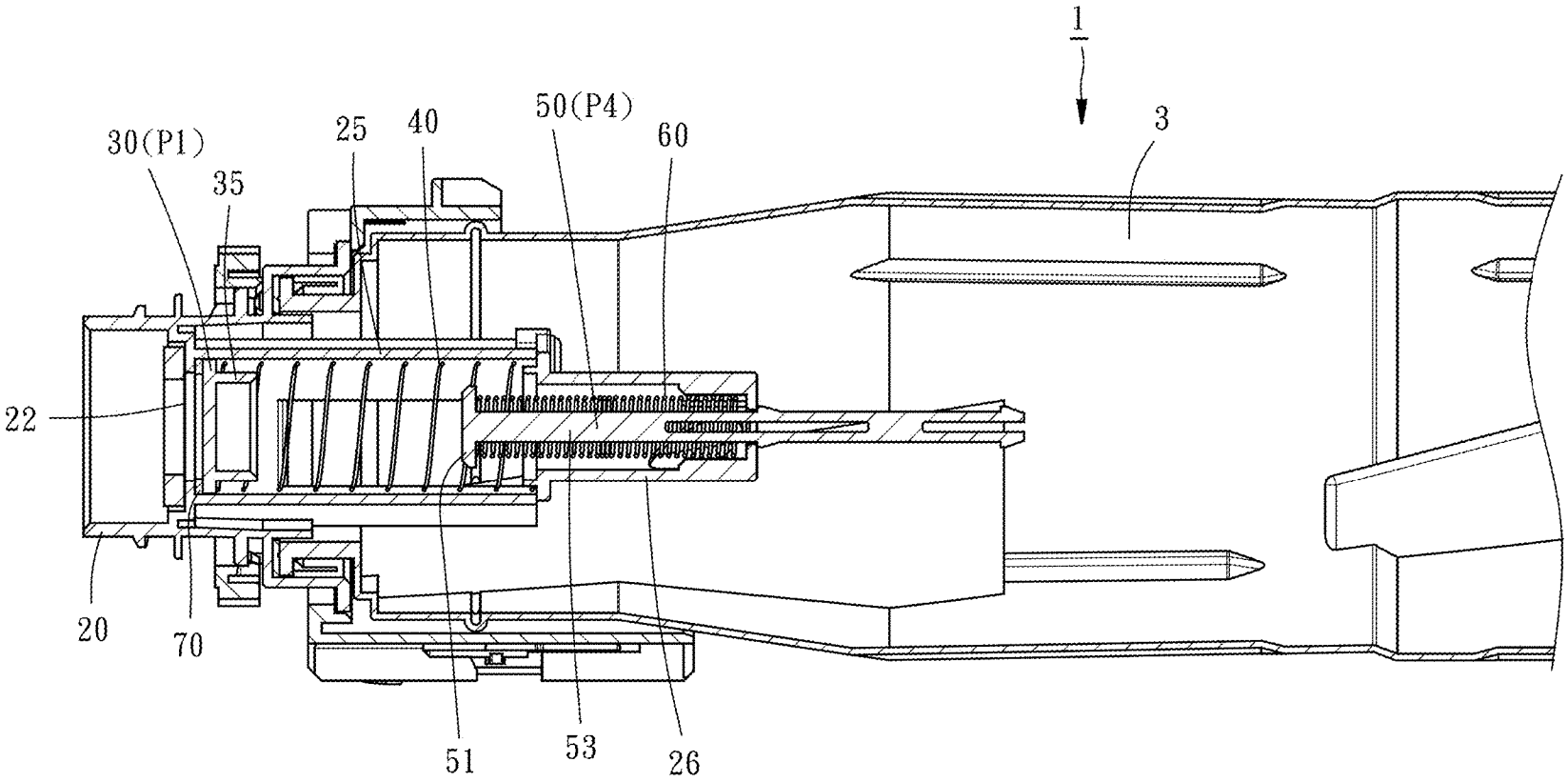
FIG. 8 is still another section view of the toner cartridge of the embodiment of the present invention, showing that the valve member again seals the opening of the fixation mount and the push member is still located at the retracted position.

The valve member 30 is moveably mounted in big-diameter section 25 of the tube portion 21 and located by an inner side of the opening 22. The valve member 30 is moveable between a sealed position P1, as shown in FIGS. 6 and 8, and an open position P2, as shown in FIG. 7. The valve member 30 includes a disc body 31 in alignment with the opening 22 of the fixation mount 20, and a retaining ring 35 extending from the disc body 31 toward the inner direction. The disc body 31 of the valve member 30 has a diameter larger than a diameter of the opening 22 of the fixation mount 20, such that the valve member 30 is capable of sealing the opening 22 of the fixation mount 20. When the valve member 30 seals the opening 22 of the fixation mount 20, the opening 22 is prohibited from communication with the open grooves 23.

The first resilient member 40 is realized as a compression coil spring in this embodiment. The first resilient member 40 is mounted in the big-diameter section 25 of the tube portion 21 of the fixation mount 20 and located between the shoulder 24 and the disc body 31 of the valve member 30. The first resilient member 40 has an end sleeved onto the retaining ring 35 of the valve member 30 and abutted against the disc body 31, such that the first resilient member 40 imparts a biasing force exerting on the valve member 30 toward the opening 22 of the tube portion 21.

Figure 5:
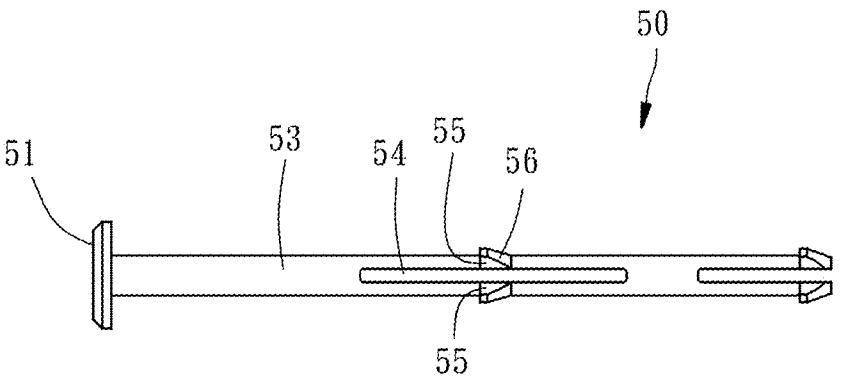
FIG. 5 is a front view of a push member of the leak-prohibiting device of the embodiment of the present invention.

Referring to FIG. 5, the push member 50 is disposed inside the tube portion 21 of the fixation mount 20 and located by an inner side of the valve member 30. The push member 50 is moveable between an extended position P3, as shown in FIG. 6, and a retracted position P4, as shown in FIGS. 7 and 8. The push member 50 includes a head 51, a shaft 53 extending from the head 51, and two engagement portions 55 at a periphery of the shaft 53. The head 51 is located in the big-diameter section 25, and the shaft 53 is extended into the small-diameter section 26 and inserted through the through hole 29. The shaft 53 of the push member 50 is provided with an axially-extending elongated groove 54 adjacent to the two engagement portions 55 in such a way that the two engagement portions 55 are located within the range of the longitudinal length of the axially-extending elongated groove 54. The axially-extending elongated groove 54 radially penetrates through the shaft 53, such that the shaft 53 is elastically deformable when receiving a radial force. The two engagement portions 55 are opposite to each other. Further, the free end of the shaft 53 is terminated as a stopper stopped at the position-limiting portion 28, as shown in FIG. 6.

The second resilient member 60 is realized in this embodiment as a compression coil spring. The second resilient member 60 is disposed in the tube portion 21 of the fixation mount 20, located between the bottom wall 27 and the head 51 of the push member 50, and extended into the small-diameter section 26. As such, the second resilient member 60 imparts a biasing force exerting on the push member 50 toward the extended position P3.

The seal member 70 is a ring-shaped member, and mounted to a lateral side of the disc body 31 of the valve member 30, namely the outer side of the disc body 31 that is close to the opening 22 of the fixation mount 20.

Referring to FIG. 6, when the toner cartridge 1 has not been installed into an electronic image-forming apparatus, the disc body 31 of the valve member 30 is forced by the biasing force of the first resilient member 40 toward the opening 22. At this status, the push member 50 is located at the extended position P3 in a way that the head 51 of the push member 50 is extended into the retaining ring 35 of the valve member 30 and firmly abutted against the disc body 31 of the valve member 30, and the engagement portions 55 of the push member 50 is located inside the tube portion 21. Further, the push member 50, which is forced by the biasing force of the second resilient member 60, exerts a force on the valve member 30 toward the opening 22. In other words, the valve member 30 is pushed by the first, resilient member 40 and the push member 50 simultaneously, such that the seal member 70 is forced to be firmly and positively abutted against a surrounding wall of the opening 22 in a compressed and deformed manner. As such, the opening 22 of the tube portion 21 of the fixation mount 20 can be positively and firmly sealed without toner leaking. Further, because the disc body 31 of the valve member 30 has a diameter D1 greater than the diameter D2 of the opening 22, the valve member 30 will not escape from the opening 22.

When the toner cartridge 1 is installed into the electronic image-forming apparatus, the connecting member 7 extends through the opening 22 and pushes on the valve member 30 with a pushing force exceeding over the biasing forces of the first and second resilient members 40 and 60, such that the valve member 30 and the push member 50 are forced to move inwardly, i.e. the valve member 30 and the push member 50 are forced to move to the open position P2 and the retracted position P4, respectively. As shown in FIG. 5, each of the two engagement portions 55 of the push member 50 is provided with an inclined surface 56. In the process that the engagement portions 55 are forced to insert through the through hole 29, the inclined surfaces 56 of the engagement portions 55 will be contacted with and then squeezed by the hole wall of the through hole 29, resulting in compression and deformation of the shaft 53, thereby facilitating passing of engagement portions 55 of the shaft 53 through the through hole 29. After the engagement portions 55 pass through the through hole 29, the engagement portions 55 of the shaft 53 rebound to their initial shape, as shown in FIG. 7, such that the push member 50 is retained at the retracted position P4 due to the grounds that the engagement portions 55 are restricted by the position-limiting portion 28, i.e. the outer surface of the bottom wall 27 that surrounds around the through hole 29. At this status, the engagement portions 55 are located outside the tube portion 21, the valve member 30 is held by the connecting member 7 at the open position P2, and the two open grooves 23 are in communication with opening 22, such that the toners contained inside the housing 3 are able to move into the toner inlet 8 through the two open grooves 23. As shown in FIG. 7, when the push member 50 is located at the retracted position P4, the engagement portions 55 are located outside the tube portion 21 and engaged with the position-limiting portion 28 of the fixation mount 20 such that the push member 50, which though receives continuously the biasing force of the second resilient member 60, is prohibited from moving from the retracted position P4 to the extended position P3.

When the user dismantles the toner cartridge 1 from the electronic image-forming apparatus due to certain reasons, the valve member 30 will be forced by the biasing force of the first resilient member 40 to move from the open position P2 back to the sealed position P1, such that the valve member 30 will again seal the opening 22. At this status, the push member 50 is still retained at the retracted position P4, as shown in FIG. 8.

With the above-disclosed structural features, the leak-prohibiting device 10 can accurately and positively seal the toner cartridge 1 to avoid leak of toners before the toner cartridge 1 is installed into an electronic image-forming apparatus thanks to the feature that the first and second resilient members 40 and 60 impart biasing forces exerting on the valve member 30 toward the opening 22. Further, after the toner cartridge 1 has been installed into and thereafter taken out of the electronic image-forming apparatus, the push member 50 will be retained at the retracted position P4. As such, when the toner cartridge 1 is reinstalled into the electronic image-forming apparatus, the user only needs to apply a sufficient force that can overcome the biasing force of the first resilient member 40 to complete the reinstallation of the toner cartridge 1. That is, reinstallation of the toner cartridge 1 can be completed by the user with less manual force, thereby achieving the objective of the present invention.

Based on the above-mentioned technical features, various modifications to the structure of the toner cartridge 1 may be made. For example, the position-limiting position 28 of the fixation mount 20 can be configured to be engaged with the engagement portions of the push member 50 by magnetic attraction or other way as long as the push member 50 can be retained by the position-limiting portion 28 at the retracted position P4. Further, the head 51 of the push member 50 can be omitted as long as the push member 50 can be abutted against the valve member 30 when the push member 50 is located at the extended position P3. Furthermore, the seal member 70 may be not a ring-shaped member but a disc-like member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A leak-prohibiting device of a toner cartridge having a housing for storage of toners and a toner outlet provided at the housing, the leak-prohibiting device comprising:

a fixation mount for being disposed in the toner outlet of the housing, the fixation mount including an opening to be communicated with inside and outside of the housing, and a position-limiting portion;

a valve member moveably mounted in the fixation mount and located by an inner side of the opening;

a first resilient member mounted in the fixation mount and imparting a biasing force on the valve member toward the opening to enable the valve member to seal the opening;

a push member provided with an engagement portion and mounted in the fixation mount in a way that the push member is located by an inner side of the valve member and moveable between an extended position where the push member is abutted against the valve member and a retracted position; and a second resilient member disposed in the fixation mount and imparting a biasing force on the push member toward the extended position;

wherein when the push member is located at the retracted position, the engagement portion of the push member is engaged with the position-limiting portion of the fixation mount such that the push member, which receives the biasing force of the second resilient member, is prohibited from moving from the retracted position to the extended position.

2. The leak-prohibiting device as claimed in claim 1, wherein the fixation mount comprises a tube portion for being extended into the inside of the housing of the toner cartridge; the tube portion of the fixation mount is provided with an open groove, through which the inside of the housing is communicated with the opening of the fixation mount; the tube portion of the fixation mount has a first end provided with the opening and a second end provided with the position-limiting portion; the valve member, the first resilient member, the push member, and the second resilient member are disposed in the tube portion.

3. The leak-prohibiting device as claimed in claim 2, wherein the tube portion of the fixation mount is provided at an inner periphery thereof with a shoulder; the first resilient member is disposed between the shoulder and the valve member.

4. The leak-prohibiting device as claimed in claim 3, wherein the tube portion of the fixation mount is provided with a big-diameter section adjacent to the opening and a small-diameter section adjacent to the position-limiting portion; the small-diameter section extends from the big-diameter section in a way that the shoulder is formed at an interface between the small-diameter section and the big-diameter section; the valve member and the first resilient member are located in the big-diameter section, and the push member and the second resilient member are extended into the small-diameter section.

5. The leak-prohibiting device as claimed in claim 2, wherein the fixation mount comprises a bottom wall located at the second end of the tube portion; the position-limiting portion is provided at the bottom wall; the second resilient member is disposed between the bottom wall and the push member.

6. The leak-prohibiting device as claimed in claim 5, wherein the push member comprises a head and a shaft extending from the head; the shaft of the push member is provided at a periphery thereof with the engagement portion; the second resilient member is disposed between the bottom wall and the head of the push member.

7. The leak-prohibiting device as claimed in claim 6, wherein the position-limiting portion comprises a through hole, through which the shaft of the push member is inserted; when the push member is located at the extended position, the engagement portion of the push member is located inside the tube portion of the fixation mount; when the push member is located at the retracted position, the engagement portion of the push member is located outside the tube portion of the fixation mount.

8. The leak-prohibiting device as claimed in claim 7, wherein the shaft of the push member is provided with an axially-extending elongated groove adjacent to the engagement portion.

9. The leak-prohibiting device as claimed in claim 1, wherein the valve member comprises a disc body in alignment with the opening of the fixation mount, and a retaining ring extending from the disc body; the first resilient member is sleeved onto the retaining ring and abutted against the disc body; when the push member is located at the extended position, the push member is extended into the retaining ring and abutted against the disc body.

10. The leak-prohibiting device as claimed in claim 9, wherein the disc body of the valve member has a diameter larger than a diameter of the opening of the fixation mount.

11. The leak-prohibiting device as claimed in claim 1, wherein the push member comprises a head and a shaft extending from the head; the shaft of the push member is provided at a periphery thereof with the engagement portion; the second resilient member has an end stopped at the head of the push member.

12. The leak-prohibiting device as claimed in claim 1, further comprising a seal member mounted to a lateral side of the valve member close to the opening of the fixation mount.

13. The leak-prohibiting device as claimed in claim 12, where the seal member is a ring-shaped member.

* * * * *